United States Patent [19]

Fleischman

[11] Patent Number: 4,506,120

[45] Date of Patent: Mar. 19, 1985

[54] ARRANGEMENT FOR PREVENTING OPERATION OF AN ELECTRIC SWITCH

[76] Inventor: Jonas Fleischman, 167 Ross St., Brooklyn, N.Y. 11211

[21] Appl. No.: 442,527

[22] Filed: Nov. 18, 1982

[51] Int. Cl.[3] ..... H01H 3/20; H01H 9/20

[52] U.S. Cl. ..... 200/42 R; 200/304

[58] Field of Search ..... 200/42 R, 42 T, 334, 200/304; 220/241, 242

[56] References Cited

U.S. PATENT DOCUMENTS

| | | | |
|---|---|---|---|
| 1,660,346 | 2/1928 | Neal | 220/241 |
| 2,832,857 | 4/1958 | Landmeier | 200/42 T |
| 3,527,914 | 9/1970 | Spacek | 200/42 T |
| 4,102,471 | 7/1978 | Lore et al. | 200/334 |
| 4,158,116 | 6/1979 | Krueger | 200/42 T |
| 4,363,944 | 12/1982 | Poirier | 200/304 |

*Primary Examiner*—John W. Shepperd

*Attorney, Agent, or Firm*—Kirschstein, Kirschstein, Ottinger & Israel

[57] ABSTRACT

An arrangement for preventing operation of an electric switch includes substantially pin-shaped male formations rigid with the switch and substantially socket-shaped female formations which are mounted on spaced mounting portions of a protecting element and which engage the male formations with snap action. The protecting element for use with a wall-mounted toggle switch has a strip-shaped configuration and its central portion located intermediate the mounting portions outwardly hugs the trajectory of pivotal movement of the actuating member of the switch. Two lugs may extend from the central portion toward the switch at the opposite sides of the trajectory of movement of the actuating member. The male formations may be mounted on connecting screws which connect a cover plate of the switch to a bracket which carries a switch housing and is mounted on a switch box. The female formations may have respective circumferential grooves and resiliently radially yieldable rings in such grooves, the rings engaging slightly conical outer peripheries of the male formations to retain the female formations on the male formations.

1 Claim, 4 Drawing Figures

ARRANGEMENT FOR PREVENTING OPERATION OF AN ELECTRIC SWITCH

BACKGROUND OF THE INVENTION

The present invention relates to electric switches in general, and more particularly to an arrangement for preventing operation of an electric switch, especially a wall switch.

There are numerous reasons why it may be desirable to temporarily prevent the operation of an electric switch so as to keep the appliance, light, or other consumer of electric current in its current state, that is, either energized or de-energized. Possibly the most prominent reason is to be found in the desire of Orthodox Jews to prevent unwitting or, especially on the part of children of tender age, intended operation of electric switches during the observance of Sabbath. In this connection, it is to be noted that, in the Jewish faith as practiced by Orthodox Jews, Sabbath is the day of rest during which no work is to be done, including lighting of fire and the like. In modern time, this prohibition has been extended by Orthodox Jewish scholars to cover operating electric appliances and also operating electric switches to control incandescent or fluorescent lights. While adults can avoid operating electric switches so long as they put their minds to it, it is very difficult to avoid the possibility that a child of an Orthodox Jewish family, especially when of a young age, would operate the light switch to put the light on when it becomes dark outside, be it due to forgetfulness, or lack of knowledge, concentration or discipline. Needless to say, such an action on the part of children will upset their parents. Similarly, practising Orthodox Jews regardless of age will be annoyed if they mindlessly turn on the lights or any appliance.

SUMMARY OF THE INVENTION

Accordingly, it is a general object of the present invention to avoid the disadvantages of the conventional electric switches.

More particularly, it is an object of the present invention to provide an electric switch which can be selectively rendered inoperative so as to avoid the possibility of inadvertent operation thereof or of operation thereof by young children.

Still another object of the present invention is to provide an arrangement for preventing operation of the electric switch which is compatible with existing electric switches.

It is yet another object of the present invention to so construct the arrangement of the above type as to be simple in construction, inexpensive to manufacture, easy to install, and reliable in operation nevertheless.

A concomitant object of the present invention is to develop the arrangement of the type here under consideration which will be particularly useful in Orthodox Jewish households for preventing undesired operation of electric switches during Sabbath.

In pursuance of these objects and others which will become apparent hereafter, one feature of the present invention resides in an arrangement for preventing operation of an electric switch including a switch body and an actuating member mounted on the switch body for movement relative thereto along a predetermined trajectory, this arrangement comprising a protecting element of such a configuration as to substantially prevent access to the actuating member of the switch when placed in a predetermined position on the switch body; and means for removably holding the protecting element in the predetermined position thereof relative to the switch body. It is particularly advantageous in this context when the removably holding means is constituted by cooperating male and female formations which are rigid with the protecting element, on the one hand, and with the switch body, on the other hand, and which engage one another with snap action in the predetermined position.

A particular advantage of this construction is that it is simple and that it permits rapid installation of the protecting element on the switch body and also simple and rapid removal of the protecting element. Yet, due to the presence of the snappingly engaging male and female formations, the protecting element cannot dissociate itself from the switch, nor can it be removed by young children who do not have the strength and/or dexterity to overcome the snapping engagement of the male and female formations.

A particularly simple yet extremely reliable construction of the arrangement according to the present invention is obtained when the female formations are substantially socket-shaped and the male formations are substantially pin-shaped. In this connection, it is especially advantageous when one of each two cooperating male and female formations has a circumferential groove at a circumferential surface thereof which faces the other of the two cooperating male and female formations in the predetermined position, and a resilient ring accommodated in the circumferential groove and yieldable in the radial directions to engage and disengage the other formation with snap action during movement of the pin-shaped male formation into and out of the socket-shaped female formation. It will be appreciated that the pin-shaped and socket-shaped configurations of the cooperating formations bring about the advantages not only of relatively simple manufacture thereof, but also of large-area engagement of such formations with one another, either directly or via the resilient ring. Moreover, a certain amount of maneuvering is needed especially for removing the protecting element to reduce the force needed for pulling the protecting element off. Thus, young children, who do not have the strength to pull the protecting element off straight out, will also not have the skill to manipulate the protecting element so as to reduce the force required for removing the same, so that they will not be able to gain access to the actuating member of the switch. A particularly advantageous construction is obtained when the male formations tions are rigid with the switch body, and when the female formations are rigid with the protecting element.

The arrangement of the present invention is particularly suited for use on a wall-mounted toggle switch in which the switch body includes a cover plate having a slot for accommodating the actuating member therein for pivoting along the predetermined trajectory. In this case, those of the formations which are rigid with the switch body are situated beyond the short sides of the slot of the cover plate and in registry therewith and are rigid with the cover plate, and the protecting element has two mounting portions each carrying one of the formations that are rigid with the protecting element and a central portion intermediate the mounting portions and situated outwardly of the predetermined trajectory. Advantageously, the protecting element is substantially strip-shaped and the aforementioned mounting portions constitute the end portions of the strip-shaped protecting element. Then the central portion of the strip-shaped protecting element advantageously extends along a course substantially outwardly hugging the predetermined trajectory.

In this construction, access can be had to the actuating member from the side, so that it could still be operated, albeit with difficulty. To prevent this possibility, it is advantageous when, in accordance with a further facet of the present invention, the central portion of the protecting element extends into the predetermined trajectory around the apex of the latter to interfere with the pivotal movement of the actuating member. However, it is currently considered even more advantageous to provide the central portion with two lugs each of which extends toward the cover plate at one side of the strip-shaped protecting element and of the predetermined trajectory to thereby prevent access to the actuating member from the respective side.

The arrangement of the present invention can be easily incorporated in conventionally constructed wall switches. A conventional wall switch includes two screws which are arranged beyond the short sides of the slot of the cover plate and in alignment therewith, these connecting screws connecting the cover plate at least to a housing of the switch. Under these circumstances, it is when, in accordance with a further aspect of the present invention, those of the formations which are to be rigid with the switch body are mounted on the connecting screws.

According to an additional concept of the present invention, there is provided a conversion kit for use with a wall-mounted toggle switch that includes a switch body including a switch housing, a cover plate having an elongated slot, two connecting screws connecting the cover plate to the switch housing at locations situated beyond and in alignment with the slot, and an actuating member mounted in the switch housing for pivoting along a predetermined trajectory and extending through the slot of the cover plate to the exterior of the switch, this kit being suited for selectively preventing access to the actuating member and thus operation of the switch. To this end, the kit includes a protecting element of such a configuration as to substantially prevent access to the actuating member when placed in a predetermined position on the cover plate, and having two spaced mounting portions; and means for removably holding the protecting element in the predetermined position thereof when assembled with the switch, the removably holding means advantageously including cooperating male and female formations respectively mountable on the connecting screws of the switch, and mounted on the mounting portions of the protecting element at a distance from one another corresponding to the distance of the connecting screws of the switch from each other, these formations engaging one another with snap action upon assembly and in the predetermined position.

The novel features which are considered as characteristic of the invention are set forth in particular in the appended claims. The improved electric switch itself, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
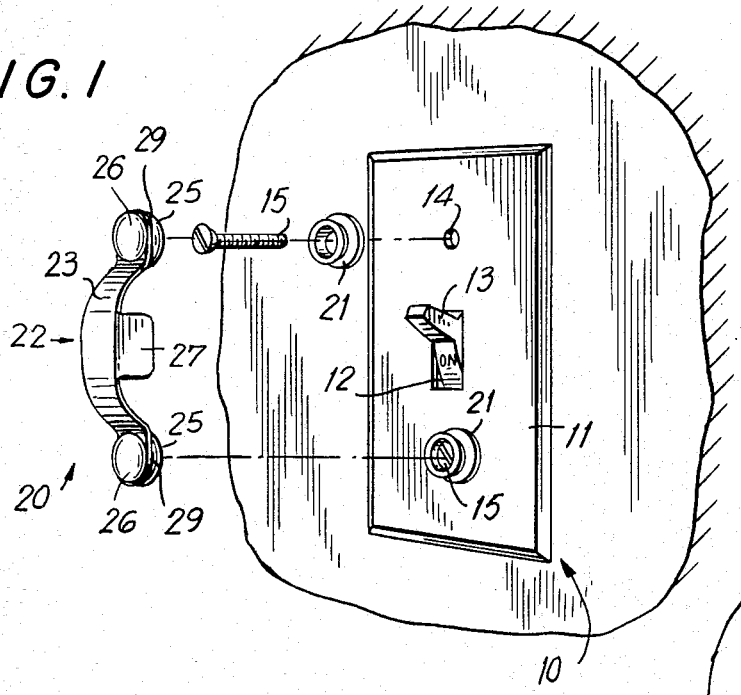
FIG. 1 is an exploded perspective view of the preventing arrangement of the present invention as used in connection with a wall-mounted recessed toggle switch of conventional construction.

Referring now to the drawing in detail, and first to FIG. 1 thereof, it may be seen that the reference numeral 10 has been used therein to identify a wall-mounted electric switch in its entirety. The electric switch 10 includes a cover plate or escutcheon 11 having a central elongated slot 12. An actuating member or toggle 13, which constitutes a part of the electric switch 10 and is pivotable along a predetermined trajectory, extends through the slot 12 to the exterior of the electric switch 10. The cover plate 11 further has two openings or bores 14 which are situated beyond and in alignment with the short sides of the slot 12. Connecting screws 15 extend through the openings 14 in the assembled condition of the switch 10 and connect the cover plate 11, in a manner to be described later, to another part of the switch 10.

The reference numeral 20 identifies a protecting arrangement of the present invention in its totality. The protecting arrangement 20 includes two male mounting members or formations 21 which are mounted on the connecting screws 15 in the assembled condition in the manner indicated in FIG. 1. A protecting element 22 which also forms a part of the protecting arrangement 20 and which is shown to have a substantially strap-shaped or strip-shaped configuration, includes a substantially bow-shaped central portion 23 and two mounting or end portions 24. A female mounting member or formation 25 is rigidly connected to each of the mounting portions 24. The female formation 25 of the mounting portion 24 carries a rounded head which is suited to be pressed upon by a finger or thumb of a user, to press the respective female formation 25 onto and into engagement with the associated cooperating male formation 21. The rounded head is denoted by the reference numeral 26. The central portion 23 of the protecting element 22 is provided with two lateral lugs 27, one on each of its sides. Only one of the lateral lugs or flanges 27 is depicted in FIG. 1, the other being hidden behind it.

Figure 2:
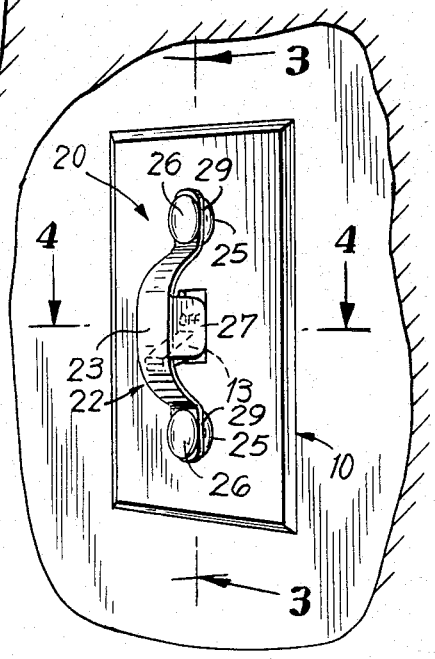
FIG. 2 is a view corresponding to FIG. 1 but with the preventing arrangement being assembled with the switch.

FIG. 2 shows the protecting arrangement 10 in its mounted condition on the switch 10. The bow-shaped protecting element 22 assumes a predetermined position relative to the switch 10 in this mounted condition. It may be seen in FIG. 2 that the heads 26 obstruct the view of the male formations 21, since the female formations 25 are placed over the male formations 21. In this position of the protecting element 22, the central portion 23 extends along the trajectory of pivoting movement of the actuating member 13 from the outside and the lugs 27 embrace the pivoting trajectory from the sides, thus obstructing access to the actuating member 13.

Figure 3:
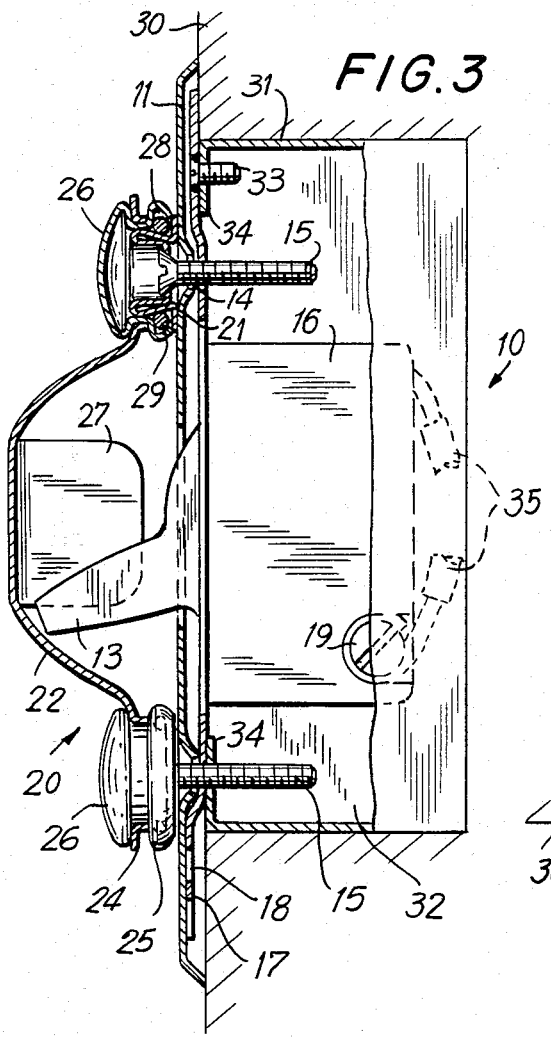
FIG. 3 is a cross-sectional view taken on line 3—3 of FIG. 2, at an enlarged scale.
Figure 4:
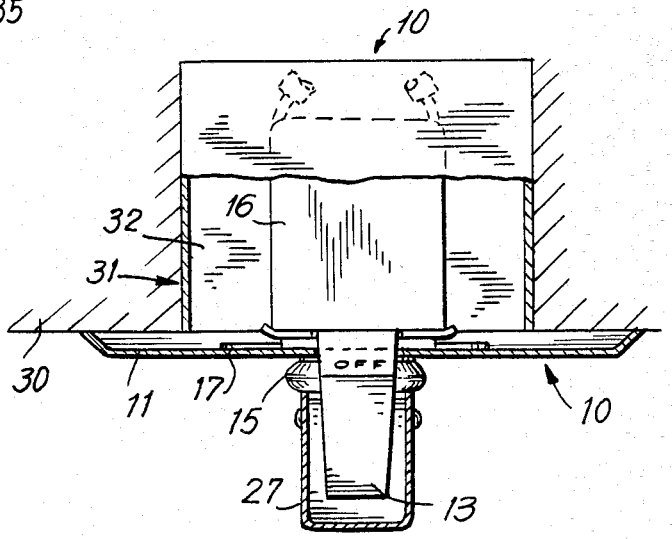
FIG. 4 is a sectional view taken on line 4—4, substantially at the same scale as FIG. 3.

Further details of the switch 10 and of the protecting arrangement 20 will become apparent from FIGS. 3 and 4 considered in conjunction with one another. So, for instance, both FIG. 3 and FIG. 4 show the lug 27 which has been hidden in FIGS. 1 and 2. Moreover, it may be seen that the switch 10 is mounted on a wall 30 by being connected to a box 31 recessedly received in the wall 30. The switch 10 further includes a switch housing 16 which accommodates the electric contacts needed for establishing and interrupting the flow of electric current through the switch 10. The actuating member 13 is pivotally mounted in the switch housing 16. The switch housing 16 is permanently connected to a support bracket 17 which spans the open end of the box 31. The bracket 17 has openings or slots 18 at its opposite ends. The switch housing 16 extends from the bracket 17 into an internal space 32 of the box 31 in the illustrated mounted position of the switch 10.

The male formation 21 is shown in FIG. 3 to be of sheet metal material and to have a folded-over configuration with an external surface which slightly conically converges toward the cover plate 11. The overall configuration of the male formation 21 is reminiscent of that of a cylindrical pin. However, the pin-shaped male formation 21 is hollow and has an opening in its bottom wall through which the connecting screw 15 passes while the head of the connecting screw 15 is received in the interior of the hollow male formation and engages the bottom wall thereof. The screw 15 passes without engagement through the opening 14 of the cover plate 11 and is threaded into an internally threaded opening of the bracket 17 to connect the male formation 21 to the bracket 17 with the cover plate 11 being confined between the male formation 21 and the bracket 17.

On the other hand, the female formation 25 has a configuration resembling a socket or cup and is formed with a circumferentially extending groove 28. The female formation 25 is shown also to be of sheet metal, of one piece with the head 26. Thus, the groove 28 is delimited by a bent portion of the sheet metal circumferential wall of the female formation 25. The groove 28 accommodates a resilient spring ring 29 which is resiliently yieldable at least in the radial directions. For this reason, the spring ring 29 is received in the groove 28 with a certain amount of radial clearance and is preferably split to facilitate the resilient yielding thereof. The spring ring 29 engages the conical outer portion of the male formation 21 in the illustrated position of the protecting element 22, but will radially yield during the introduction of the male formation 21 into and its withdrawal from the female formation 25. This provides for snap-action retention of the female formation 25 and thus of the preventing member 22 on the male formation 21 and thus on the bracket 17 of the switch 10.

The bracket 17 is secured to the box 31. As shown in the top part of FIG. 3, this can be accomplished, depending on the construction of the box 31 which is standardized, by threading a screw 33 into an inwardly extending flange 34 of the box 31. However, the box 31 may also have a threaded bore in its respective wall or in a protuberance formed on such wall, and the screw 33 is then threaded into such threaded bore. For a different construction of the box 31 which has an internal flange 34' located closer to the switch housing 16, the connecting screw 15 also serves to connect the bracket 17 to the flange 34' by being threaded into an opening of the latter. The electric current is supplied to the switch 10 by respective leads 35 which are connected to the switch housing 16 by respective terminal screws 19, only one of which is shown in FIG. 3.

The protecting arrangement 20 of the present invention has been described above as being mounted on a wall switch 10 which is recessed into the wall 30. However, it will be appreciated that the protecting arrangement 20 may also be used on a wall switch whose box is externally mounted on the wall, such as in garages, utility rooms and outside the house where external shielded or armored wiring is being used.

It will be understood that each of the elements described above, or two or more together, may also find a useful application in other types of arrangements differing from the type described above.

While the invention has been illustrated and described as embodied in a wall-mounted toggle switch, it is not intended to be limited to the details shown, since various modifications and structural changes may be made without departing in any way from the spirit of the present invention. So, for instance, the lateral lugs 27 of the protecting element 22 may be omitted. In this instance, it is advantageous to give the central portion 23 such a configuration as to extend into the trajectory of pivoting movement of the actuating member 13 around the apex of such trajectory, to thereby interfere with the pivotal movement of the actuating member 13.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. An arrangement for preventing operation of a wall-mounted electric toggle switch of the type including a switch body including a switch housing, a cover plate having an elongated rectangular slot, a pair of connecting screws connecting the cover plate to the switch housing at locations situated beyond and in alignment with the slot, and an actuating member mounted in the switch housing for pivoting along a predetermined trajectory and extending through the slot of the cover plate to the exterior of the switch, for selectively preventing access to the actuating member and thus operation of the switch, said arrangement comprising:

a substantially strip-shaped protecting element having a pair of spaced-apart end mounting portions, a central portion intermediate the latter and situated outwardly of the predetermined trajectory and extending along a course substantially outwardly hugging the predetermined trajectory, and two lug portions on the central portion and extending toward the cover plate at both sides of said element and of the predetermined trajectory to prevent lateral access to the actuating member, said element portions being configured as to substantially prevent access to the actuating member when placed in a predetermined position on the switch; and snap-action means for removably holding said protecting element in said predetermined position thereof relative to the switch, said snap-action means including two cooperating pairs of substantially pin-shaped male formations and substantially socket-shaped female formations, said male formations being rigid with the switch body and including through-extending apertures through which said connecting screws may be directed prior to their threadable engagement with said switch housing thereby to permit said male formations to be fixedly mounted on the connecting screws of the switch, said female formations being rigid with said protecting element and being mounted on the mounting portions of said protecting element, said two pairs of said formations engaging each other with snap action in said predetermined position, one of each two cooperating formations having a circumferential groove at a circumferential surface thereof facing the other formation in said predetermined position, and a resilient ring accommodated in said groove and yieldable in the radial direction to engage and disengage said other formation with snap action during movement of said pin-shaped male formation into and out of said socket-shaped female formation, each female formation having a rounded finger- or thumb-pressing surface to press the respective female formation onto and into engagement with the associated cooperating male formation, said lug portions on said protecting element extending toward the cover plate for a distance sufficient to serve as a convenient handhold for a user to grasp and disengage said female formations from said male formations.

* * * * *